United States Patent [19]

Fermi et al.

[11] 4,133,264

[45] Jan. 9, 1979

[54] CLAMPING ASSEMBLY FOR THIN PRINTING PLATES

[75] Inventors: Rudy Fermi, South Bend, Ind.; John Pickard, San Antonio, Tex.; Alex Kocsis, Granger; David Bratton, Mishawaka, both of Ind.; Gerald Kasner, Union, Mich.

[73] Assignee: K & F Manufacturing Co., Inc., Granger, Ind.

[21] Appl. No.: 790,937

[22] Filed: Apr. 26, 1977

Related U.S. Application Data

[63] Continuation-in-part of Ser. No. 636,454, Dec. 1, 1975.

[51] Int. Cl.[2] ..... B41F 27/06

[52] U.S. Cl. ..... 101/415.1

[58] Field of Search ..... 101/415.1, 378, 382 R, 101/127.1, 128.1

[56] References Cited

U.S. PATENT DOCUMENTS

| | | | |
|---|---|---|---|
| 2,386,214 | 10/1945 | Harrold | 101/415.1 |
| 2,730,948 | 1/1956 | Mitchell | 101/415.1 |
| 3,557,695 | 1/1971 | Preuss | 101/415.1 |
| 3,896,727 | 7/1975 | Ruckdeschel | 101/383 X |

FOREIGN PATENT DOCUMENTS

| | | | |
|---|---|---|---|
| 2501266 | 7/1975 | Fed. Rep. of Germany | 101/415.1 |
| 770356 | 9/1934 | France | 101/415.1 |

*Primary Examiner*—Ronald E. Suter
*Attorney, Agent, or Firm*—Craig & Antonelli

[57] ABSTRACT

A clamping apparatus is provided for holding thin flexible printing plates, especially Mylar printing plates, in position on a press cylinder. A metallic rigid clamp body is provided which is attachable to the press cylinder in a gap or groove formed between facing ends of plate supporting shims and/or edges of a groove formed in the press cylinder. A pivot bar having a serrated clamping edge is pivotally supported in the clamp body for cooperation with a fixed facing clamping surface of the clamp body to clamp the leading edge of the "Mylar" plate. A "Mylar" spring is provided for providing a continuous light biasing force on the pivot bar in the clamping direction. The clamping action of the pivot bar is by way of camming action and engagement of the serrated surface into the "Mylar" or other printing plate material, such that movement of the plate in a direction out of the clamping space tends to increase the clamping force of the pivot bar. The clamp body further slidably accommodates a tension bar which has a single fixed groove for engaging and holding the trailing edge of the printing plate. This tension bar is spring biased to a position corresponding to clamping of the printing plate trailing edge.

21 Claims, 5 Drawing Figures

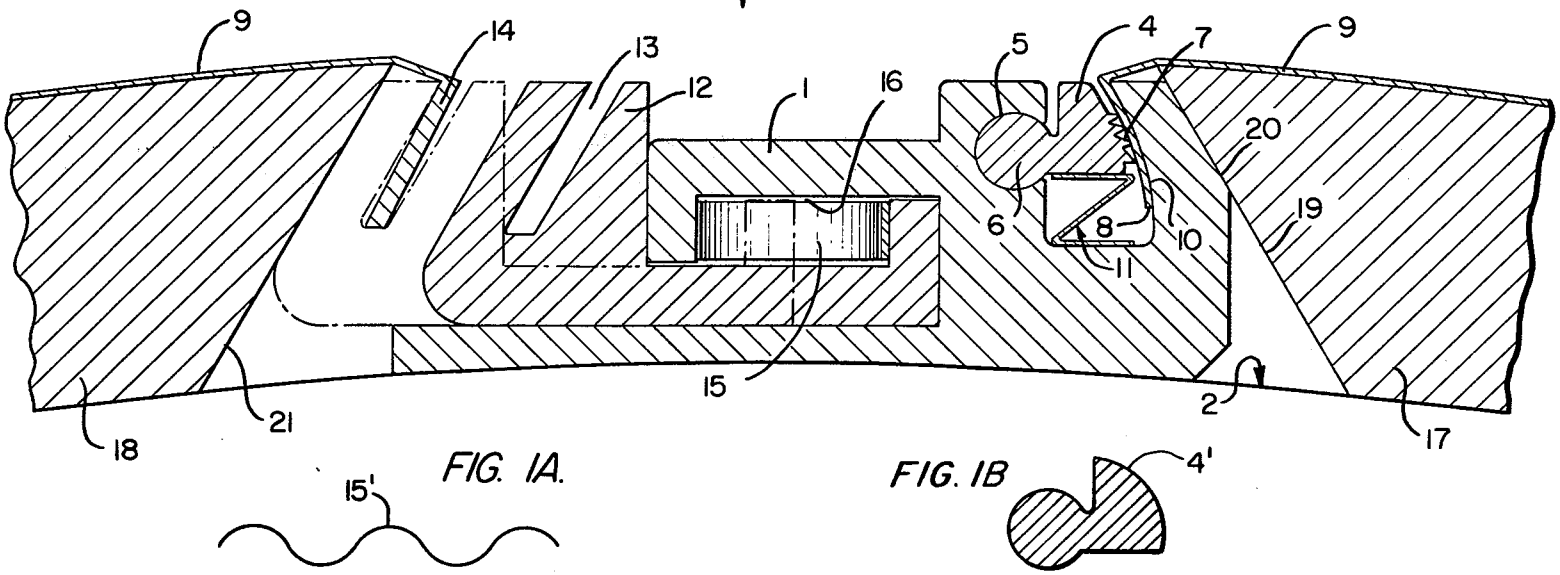
FIG. 1.
1A
1
2
4
5
6
7
8
9
10
11
12
13
14
15
16
17
18
19
20
21
FIG. 1B
4'
FIG. 1A.
15'
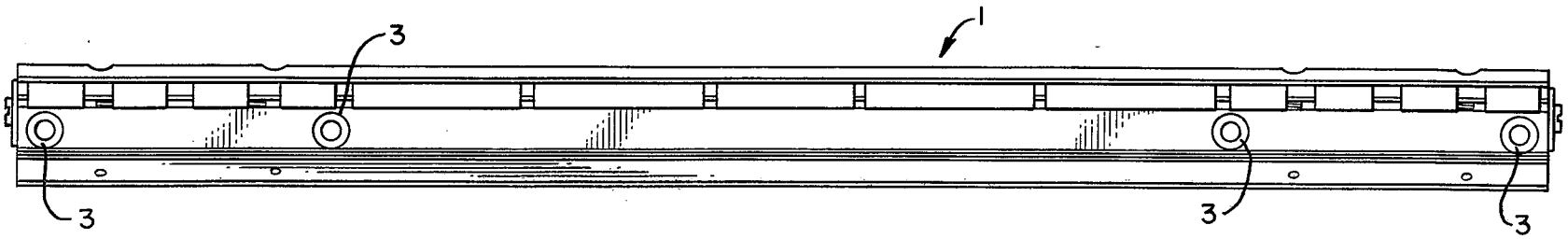
FIG. 4.
1
3

CLAMPING ASSEMBLY FOR THIN PRINTING PLATES

BACKGROUND AND SUMMARY OF THE INVENTION

This application is a continuation-in-part application of our co-pending application Ser. No. 636,454 filed Dec. 1, 1975 and entitled Printing Plate Clamping Assembly. The subject matter of this co-pending parent application is incorporated herein by reference to the extent necessary for a complete understanding of the present invention.

The present invention relates to a printing plate clamping assembly, and more particularly, to apparatus for clamping flexible thin printing plates in position on a press cylinder. The above-mentioned co-pending application also relates to a printing plate clamping assembly for this flexible printing plates. The present invention is primarily directed to an improvement in the invention described and claimed in said co-pending application. In said co-pending application, a separate clamping assembly was provided in a groove intermediate facing end portions of shim members, or alternatively, in a groove formed in the press cylinder itself. In each of the embodiments of this co-pending application, one of the leading or trailing edge of the printing plates being clamped was anchored directly at the shim member or the edge of the groove in the press cylinder. For this purpose, the shim member and/or groove were undercut so as to provide a firm anchoring of the edge of the printing plate.

Prior arrangements, including the arrangement of U.S. Pat. No. 3,896,727, and the arrangement of the above-noted co-pending application, involve relatively complex and expensive to manufacture clamping assemblies. The present invention contemplates an improved arrangement which is more simple and economical to construct, which is useful for certain applications experienced in practice, particularly with Mylar or other nonmetallic plates, and which avoids the need for any special undercut construction at the saddle or shim members against which the printing plate is pressed for use during printing operations.

According to the present invention, a clamp body is provided which is detachably attachable to the press cylinder in a groove formed intermediate the ends of the shim members, or alternatively, in a groove formed in the press cylinder itself. The clamping mechanism for engaging the respective leading and trailing edges of the printing plate are provided on the clamp body itself, of structure carried therewith, so that the respective ends of the plate supporting surface members need have no special construction for anchoring the printing plate.

In preferred embodiments, a pivot bar is pivotally mounted at the clamp body and contains a serrated edge which engages with a camming effect against the leading edge of the printing plate to clamp the same against a surface of the clamp body. In preferred embodiments, a light spring, preferably a Mylar spring, is provided for biasing the pivot bar toward a clamping position, it being noted that the actual clamping effect is primarily from the wedging action due to the engagement of the serrations into the leading end of the plate and the pivotal movement and consequent clamping engagement of the pivot bar against the plate. In particularly preferred embodiments, the pivot bar is constructed with a part-cylindrical portion which is rotatably mounted in a correspondingly shaped part-cylindrical recess in the clamp body, thereby obviating the need for any expensive hinge constructions and the like.

In preferred embodiments, the trailing edge of the printing plate is clamped by means of a tension bar which has a radially outwardly extending inclined groove for accepting the trailing edge of the plate. This tension bar is preferably spring-biased into a clamping position. This tension bar is linearly guided in a groove or opening of the clamp body.

The combination of the clamp body with the pivotally mounted pivot bar and the slidably mounted tension bar results in a very simple and reliable, economical to construct, clamping assembly, which accommodates very well the clamping of certain types of printing plates, especially Mylar printing plates, commonly in use.

In other preferred embodiments, the above-noted trailing edge clamp is arranged on a common clamp body also carrying a leading edge clamp similar to the clamp of U.S. Pat. No. 3,896,727.

These and other objects, features and advantages of the present invention will become more apparent from the following description when taken in connection with the accompanying drawings, which show, for purposes of illustration only, several embodiments in accordance with the present invention.

BRIEF DESCRIPTION OF THE DRAWINGS

FIG. 1 is a part-cross-sectional view depicting a first preferred embodiment of the clamping assembly of the present invention in conjunction with a press cylinder, shim members mounted on the press cylinder, and a Mylar printing plate clamped by the clamping assembly;

FIG. 1A shows a modified sine spring which can be alternatively used in the FIG. 1 embodiment;

FIG. 4 is a schematic plan view taken from the direction of arrow A in each of FIGS. 1–3, which depicts the clamping assembly of the present invention.

DETAILED DESCRIPTION OF THE DRAWINGS

Figure 2:
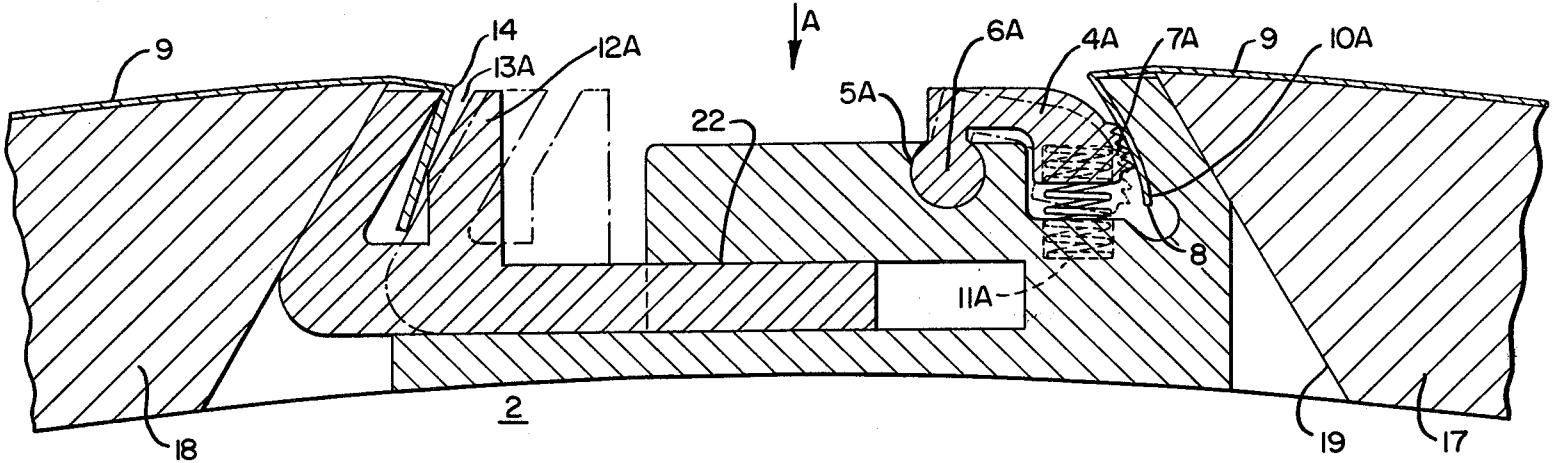
FIG. 2 is a view similar to FIG. 1, however showing a different preferred embodiment of the clamping assembly of the present invention.
Figure 3:
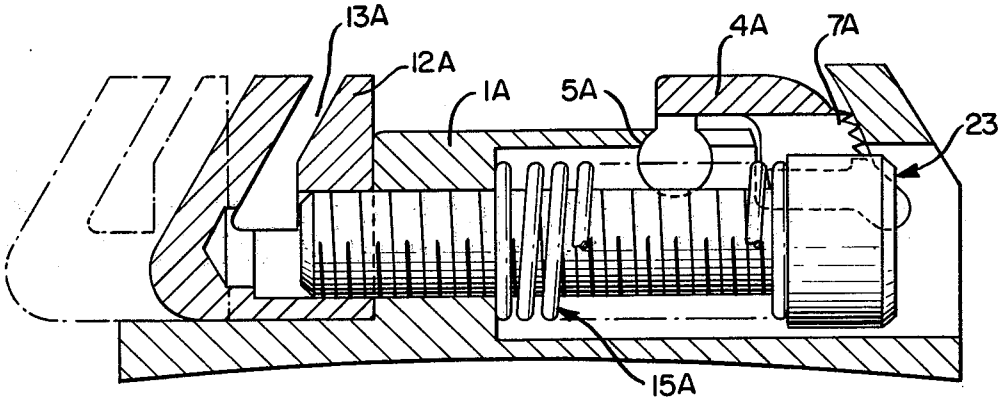
FIG. 3 is a cross-sectional view of a portion of the clamping assembly of FIG. 2, showing certain constructional features thereof.

Throughout the various views, like reference numerals are used to designate similar structures.

Referring to FIG. 1, a clamp body 1 is provided which is attachable directly to the surface of press cylinder 2 by means of screws 3 (FIG. 4). The body 1 is preferably formed of a single piece of solid metal such as aluminum. At the righthand side of clamp body 1 a pivot bar 4 is mounted for limited pivotal movement in a cylindrical recess 5 of the clamp body 1. The part-cylindrical portion 6 of pivot bar 4 which is accommodated in recess 5 can be assembled in the axial direction (perpendicular to the plane of FIG. 1) by merely sliding the same into place. Pivot bar 4 includes serrations 7 at the one edge thereof, which serrations 7 are clampingly engageable against leading edge portion 8 of the Mylar plate 9 being clamped. The pivot bar 4 and its serrations 7 clampingly force the leading edge 8 of plate 9 against groove edge surface 10 formed in the plate body 1 in facing relationship to the pivot bar 4. A relatively weak Mylar spring 11 is provided which continuously provides a light biasing force on pivot bar 4 in the clamping direction. However, it should be understood that the clamping force on the leading edge 8 of the Mylar plate is by way of the wedging effect and the serrations 7, the wedging effect resulting from the pivotal movement of the pivot bar 4, which pivotal movement results in a tighter clamping of the leading edge 8 when the pivot bar 4 is moved in the counterclockwise direction as viewed in FIG. 1. However, the serrations 7 can be omitted and a smooth surfaced pivot bar 4' utilized instead.

At the left side of the clamp body 1, a tension bar 12 is provided which has a groove 13 for holding and accommodating the trailing edge 14 of the Mylar plate 9. A sine-wave compression spring 15 is provided in the undercut groove portion 16 of clamp body 1 for applying a continuous biasing force against the tension bar 12 so as to move it in the righthand direction as viewed in FIG. 1. In this manner, the spring 15 continuously forces the tension bar toward the clamping direction.

Operation of the embodiment of FIG. 1 is as follows. First, the leading edge 8 of the Mylar plate is inserted in the opening between the pivot bar 4 and the groove edge 10 on clamp body 1. To accommodate insertion of this leading edge 8, pivot bar 4 need merely be rotated slightly in the clockwise direction against the force of the Mylar spring 11. Once the leading edge 8 has been inserted into this space, one need merely release the pivot bar 4 and the pivot bar 4 with serrations 7 will wedgingly clamp the leading edge 8 against the groove edge 10 of the clamp body 1, with increasing clamping force resulting from increasing circumferential force on the Mylar plate 9 in a direction away from the leading edge 8 (tending to pull the Mylar plate out of the clamping action at the leading edge). The Mylar plate is then merely wrapped around the pressed cylinder and/or shim members 17 and 18 so that the trailing edge 14 can be inserted into the groove 13 of the tension bar 12. For insertion of this trailing edge 14 into the groove 13 of tension bar 12, one need merely move the tension bar in the lefthand (counterclockwise) direction against the force of spring 15 to the position shown in dash lines in FIG. 1. Once the trailing edge 14 is inserted in the groove 13 the tension bar need merely be released and the spring force of spring 15 will automatically clamp the same resiliently.

In preferred embodiments, the clamping body 1 is constructed so as to abuttingly engage the edges of the groove in a press cylinder or the shim 17 as shown at abutting edges 19-20. However, the facing edge 19 of the shim member need be of no special construction for anchoring the leading edge of the printing plate, since the leading edge is clamped exclusively by the clamp body and the pivot bar. Also, at the trailing edge of the printing plate, the construction of the edge 21 of the shim member 18 need not serve to form an anchor for the printing plate, since the anchoring and clamping is done exclusively by the groove 13 and tension bar 14.

The simplicity of the design of this preferred FIG. 1 embodiment is such as to provide a reliable repeatable clamping action for mounting printing plates, irrespective of the condition of the facing edges 19 and 21 of the shim members (or corresponding edges of a groove formed in the printing press cylinder). Not only can the clamping assembly of the present invention be constructed in a simple and inexpensive manner, the operation of same in use to clamp and unclamp printing plates is very simple.

FIG. 1A shows a sine shaped spring 15' made out of piano wire (wire 0.046" in diameter) which can be used in place of spring 15 of FIG. 1 according to another preferred embodiment.

The FIG. 2 embodiment of the present invention is generally similar to and operates in a similar manner as the embodiment of FIG. 1. Accordingly, correspondingly functioning parts of the FIG. 2 embodiment are designated by corresponding reference numerals with the suffix "A". The clamp body 1A is formed of rigid metal and is attached by threaded screws to the press cylinder 2. Pivot bar 4A, by way of its cylindrical portion 6A is mounted for partial rotational movement in groove 5A. Pivot bar 4A includes serrations 7A which engage against leading edge 8 of Mylar plate 9, clamping the same against groove edge 10A of clamp body 1A. A spring 11A constructed as a coil spring or a series of coil springs disposed along the length of the pivot bar or its separate part, serves to provide a light biasing force on a pivot bar 4A toward the clamping direction.

Tension bar 12A is slidably accommodated in groove 22 of the clamp body 1A. Tension bar 12A includes a groove 13A for engaging the trailing edge 14 of the Mylar printing plate 9. While the FIG. 1 embodiment included a sine-wave compression spring extending laterally along the tension bar in the clamp body 1, the FIG. 2 embodiment includes a series of coil springs 15A supported at machine screws 23 disposed along the lateral length of the clamp body 1A. The FIG. 2 embodiment operates substantially as described above for the FIG. 1 embodiment with the leading edge being clamped between the serrations 7A and the edge 10A and with the trailing edge being held in position by the rigid slot 13A and the movable tension bar 12A.

Figure 5:
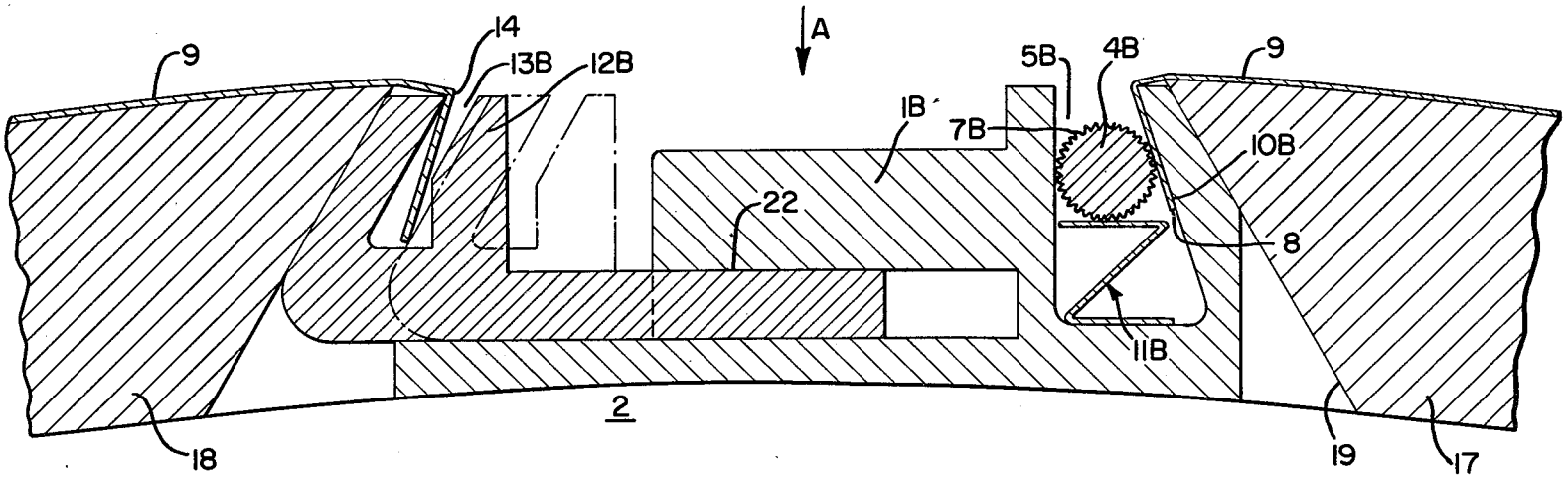
FIG. 5 is a view similar to FIGS. 1 and 2, however showing a further preferred embodiment of the clamping assembly of the present invention.

The FIG. 5 embodiment of the present invention is generally similar to and operates in a similar manner as the embodiments of FIGS. 1 and 2. Accordingly, correspondingly functioning parts of the FIG. 5 embodiment are designated by corresponding reference numerals with the suffix "B". The clamp body 1B is formed of rigid metal and is attached by threaded screws to the press cylinder 2. Knurled cylindrical members 4B (there being a plurality of separate ones arranged end to end) are supported in groove 5B by spring 11B. Cylindrical members 4B include knurled surface portions or sections 7B which engage against leading edge 8 of Mylar plate 9, clamping the same against groove edge 10B of clamp body 1B. A spring 11B constructed as a Mylar spring like spring 11 of FIG. 1 or as a coil spring or a series of coil springs disposed along the length of the members 4B serves to provide a light biasing force on members 4B toward the clamping direction.

Tension bar 12B is slidably accommodated in groove 22 of the clamp body 1B. Tension bar 12B includes a groove 13B for engaging the trailing edge 14 of the Mylar printing plate 9. The FIG. 5 embodiment preferably utilizes either a sine-wave compression spring (band spring like 15', in which case body 1B and bar 12B will be provided with undercut portions as shown in FIG. 1 or wire spring like 15) extending laterally along the tension bar in the clamp body 1B or a series of coil springs (like 15A of FIG. 2) supported at machine screws 23 disposed along the lateral length of the clamp body 1B. The FIG. 5 embodiment operates substantially as described above for the FIGS. 1 and 2 embodiments with the leading edge being clamped between the knurled serrations 7B and the edge 10B and with the trailing edge being held in position by the rigid slot 13B and the movable tension bar 12B.

As pointed out above, the illustrated preferred embodiments of the present invention relate to constructions wherein detachable shim members 17, 18 are attached to the press cylinder 2 to radially space the thin flexible plate members 9 so as to accommodate press cylinders originally constructed for use with particular type plates. However, preferred embodiments also contemplated by the present invention with integrally formed press cylinders having a cutout groove or formed groove portion similar to the space or gap between the facing end portions 19, 21 of the shim members described. Such last-mentioned preferred embodiments are similar in all other respects to the above-described embodiments.

Since the screws 3 are readily detachable the clamp assembly can be readily removed and turned around to accommodate reversal of the clamping direction. Because the entire trailing and leading edge clamp assembly is separate of the cylinder and shim means, such reversal as well as adjustment of position, as by slotted holes in the body 1 for screws 3, can be readily accommodated.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. A clamping assembly for releasably clamping a thin flexible printing plate in position against an outwardly facing plate supporting surface on a press cylinder; said clamping assembly comprising:

a clamp body having a plate edge clamping surface, and a pivot bar means having a pivot bar surface which is in facing relationship to said plate edge clamping surface, said pivot bar means being supported for pivotal movement between a first non-clamping position permitting insertion of a first edge portion of a printing plate between said pivot bar surface and said plate edge clamping surface and a second clamping position with said pivot bar surface clampingly forcing said first edge portion against said plate edge clamping surface and preventing withdrawal of said first edge portion, wherein said clamp body is a rigid member having a first groove which opens in the radially outward direction when said clamp body is attached to a press cylinder, one side wall of said first groove constituting said plate edge clamping surface, and serving to engage the first edge of the plate wherein said rigid body further includes a second groove, said second groove serving to pivotally accommodate a corresponding portion of said pivot bar means, and wherein said rigid member includes a third groove which extends linearly in a generally circumferential direction of said press cylinder when said clamp body is attached to the press cylinder, and wherein tension bar means having a radially extending groove for holding the second edge of the plate is slidably mounted in said third groove.

2. A clamping assembly according to claim 1, wherein resilient means are provided for continuously forcing said pivot bar means toward said second clamping position.

3. A clamping assembly according to claim 1, wherein said pivot bar means and clamp body are configured such that movement of said printing plate in an unclamping direction automatically increases the clamping force of said pivot bar means due to wedging action and engagement of said pivot bar surface with the first edge portion.

4. A clamping assembly according to claim 1, wherein said clamp body is formed separately from said plate supporting surface whereby clamping of said printing plate is formed at a position spaced from said plate supporting surface.

5. A clamping assembly according to claim 1, wherein said plate supporting surface is formed directly on said press cylinder, said clamp body being disposed in a groove formed in said press cylinder, said plate edge clamping surface being spaced from and separate from said press cylinder.

6. A clamping assembly according to claim 5, wherein said plate is made of Mylar and wherein said first edge portion is a leading edge of said plate.

7. A clamping assembly according to claim 1, further comprising shim means configured to accurately radially position said printing plate with respect to the surface of the press cylinder, wherein said plate supporting surface is formed on said shim means, and wherein said clamp body is disposed in a gap formed by respective facing edges of said shim means.

8. A clamping assembly according to claim 7, wherein said plate edge clamping surface is spaced from and separate from said shim means.

9. A clamping assembly according to claim 8, wherein said plate is made of Mylar and wherein said first edge portion is a leading edge of said plate.

10. A clamping assembly according to claim 1, wherein said plate is made of Mylar and wherein said first edge portion is a leading edge of said plate.

11. A clamping assembly according to claim 1, wherein said pivot bar means includes at least one pivot bar having a part-cylindrical portion engaging loosely in a correspondingly shaped cylindrical groove in said clamp body.

12. A clamping assembly according to claim 1, wherein Mylar spring means are mounted in said first groove for continuously lightly forcing said pivot bar means toward said second clamping position.

13. A clamping assembly according to claim 12, wherein sine-wave compression spring means are mounted in said third groove for continuously biasing said tension bar means toward a plate clamping position.

14. A clamping assembly according to claim 13, wherein said radially extending groove of said tension bar means and said first groove are disposed spaced from and separate from said plate supporting surface, whereby the ends of said plate are held exclusively by said tension bar means and said pivot bar means, without regard to the configuration of the circumferential end portions of the member forming said plate supporting surface.

15. A clamping assembly according to claim 1, wherein said pivot bar surface is smooth.

16. A clamping assembly according to claim 1, wherein said pivot bar surface is roughened.

17. A clamping assembly for releasably clamping a thin flexible printing plate in position against an outwardly facing plate supporting surface on a press cylinder; said clamping assembly comprising:

a plurality of clamping members, a first of said clamping members being formed by a clamp body having a generally radially outwardly directed groove, one surface of said groove forming a plate edge clamping surface, and a second of said clamping members being formed by at least one pivot bar means located within said groove for clamping a first edge portion of a printing plate against said clamping surface, wherein said pivot bar means is supported by a socket-type pivotal interconnection between said clamp body and pivot bar means formed by a partially cylindrical portion of one of the first and second clamping members being rotatably retained within a partially cylindrical recess in the other of said clamping members for pivotal movement between a first non-clamping position, permitting insertion of said first edge between the clamping surface of the clamp body and a clamping portion of said pivot bar means which extends within said groove in facing relationship to said clamping surface, and a second clamping position, with said clamping portion forcing said first edge portion against said clamping surface preventing withdrawal of the first edge, and wherein spring means for biasing said pivot bar means toward said second position is provided within said groove.

18. A clamping assembly according to claim 17, wherein said clamping portion of the pivot bar means is provided with a roughened sheet engaging surface.

19. A clamping assembly according to claim 17, comprising a third clamping member slidingly received within said clamping body and having a groove for receiving a trailing edge of said printing plate, and resilient means for biasing said third clamping in a direction applying tension to a printing plate held within said grooves.

20. A clamping assembly according to claim 19, wherein said resilient means is formed by a flange of said third clamping member being located within said clamping body so as to have a surface thereof facing an inner wall of said clamp body and spring means between the flange surface and the inner wall.

21. A clamping assembly according to claim 19, wherein said tensioning means is comprised by screws adjustably threaded within said third clamping member and spring means disposed about said screws in engagement with the clamp body.

* * * * *